US005912682A

United States Patent [19]

Parkos

[11] Patent Number: 5,912,682

[45] Date of Patent: Jun. 15, 1999

[54] METHOD OF PRINTING USING INKS HAVING DIFFERENT CHARACTERISTICS

[75] Inventor: Maria P. Parkos, Southbury, Conn.

[73] Assignee: Pitney Bowes Inc., Stamford, Conn.

[21] Appl. No.: 08/717,784

[22] Filed: Sep. 23, 1996

[51] Int. Cl.[6] ..... B41J 2/145; B41J 2/15; B41J 29/38

[52] U.S. Cl. ..... 347/40; 347/14

[58] Field of Search ..... 347/40, 43, 12, 347/95, 100, 14; 106/31.15, 31.49, 31.58; 524/104

[56] References Cited

U.S. PATENT DOCUMENTS

| | | | |
|---|---|---|---|
| 3,869,986 | 3/1975 | Hubbard | 101/91 |
| 4,404,566 | 9/1983 | Clark et al. | 347/89 |
| 4,608,575 | 8/1986 | Morgan | 346/33 R |
| 4,641,155 | 2/1987 | Zoltan | 347/68 |
| 4,743,924 | 5/1988 | Scardovi | 347/10 |
| 4,910,528 | 3/1990 | Firl et al. | 347/17 |
| 4,953,995 | 9/1990 | Sims et al. | 400/124.07 |
| 4,963,882 | 10/1990 | Hickman | 347/41 |
| 5,256,192 | 10/1993 | Liu et al. | 347/100 |
| 5,256,193 | 10/1993 | Winnek et al. | 347/100 |
| 5,423,617 | 6/1995 | Marsh et al. | 400/82 |
| 5,554,842 | 9/1996 | Connell et al. | 235/491 |
| 5,654,744 | 8/1997 | Nicoloff, Jr. et al. | 347/43 |
| 5,674,314 | 10/1997 | Auslander et al. | 106/21 A |

FOREIGN PATENT DOCUMENTS

| | | | |
|---|---|---|---|
| 558236 | 9/1993 | European Pat. Off. | B41J 2/17 |

*Primary Examiner*—N. Le
*Assistant Examiner*—Thinh Nguyen
*Attorney, Agent, or Firm*—Alberta A. Vitale; Angelo N. Chaclas; Melvin J. Scolnick

[57] ABSTRACT

A method of printing an image on an image receiving medium utilizing ink jet printing technology is disclosed. The image, particularly a postage meter indicia, is composed of two discrete portions, one having graphic information which need not be machine readable, the other having alpha-numeric information which must be machine readable and therefore must be water fast. The graphic information, however, must be printed with an ink that contains fluorescent material. The image is thus printed with two separate ink jet printing devices operating simultaneously, one of the printing device being supplied with fluorescent ink that is not water fast, and the other being supplied with water fast ink.

8 Claims, 2 Drawing Sheets

METHOD OF PRINTING USING INKS HAVING DIFFERENT CHARACTERISTICS

BACKGROUND OF THE INVENTION

This invention relates generally to the field of printing utilizing ink jet technology, and more particularly to a method of utilizing ink jet technology to print discrete portions of postage indicia images with inks having distinct and unique characteristics.

Postage meters having printing devices for printing postage indicia on envelopes have long been well known and have achieved almost universal acceptance and use in all manner of commercial environments, as well as in limited forms of home use. Typically the postage meter is part of a mailing machine which has the capability of automatically feeding a succession of envelopes from a supply thereof past the postage meter where the printing device prints the postage indicia on the envelope, and then ejecting the envelopes from the mailing machine for further processing, such as stacking for transfer to a postal facility.

The traditional forms of printing devices utilized in postage meters for half a century or more have used metal dies suitably mounted in the printing device to which ink was applied between each printing operation by a suitable inking device. In one form of printing device, the die had a curved surface and was mounted on a rotating drum so that it could print an indicia on an envelope while the envelope was moving through the postage meter. In another form, the die was flat, and the printing operation took place while the forward motion of the envelope was momentarily arrested and the envelope pressed into firm engagement with the die. These forms of printing devices were generally mechanically complex, large and cumbersome and relatively expensive, and due to the relatively permanent nature of the die, any change in the format of the indicia, whether in the graphics or alpha-numeric component of the indicia, required the purchase of a new die, which itself was expensive.

The advent of ink jet technology opened up a new field of printing techniques for printing postage indicia on envelopes, with the result that new types of postage meters could be developed utilizing the ink jet technology in one form or another which would be far less complex, less cumbersome and less costly, and any desired changes in the format of the indicia could be made simply by changing software in the postage meter. Another advantage of this printing technique is that it affords higher resolution print than the conventional impact meter printing techniques. Thus, the new technology, which had become so prevalent in other printing applications, held the promise of dramatically changing the time honored traditional forms of postage meter printing devices.

In the course of development of various forms of ink jet printing devices for use in postage meters, one very significant problem soon became apparent, which was that postage indicia could not be printed with the typical inks developed for use in ink jet printing devices. One significant difference between general printing applications and the printing of postage indicia is that the latter is, in effect, printing money, and therefore appropriate security measures must be taken to ensure that indicia already printed on envelopes cannot be reused.

This problem first arose with the use of postage stamps which were adhesively applied to envelopes to evidence the payment of the fee required for the handling of mail, and the problem was solved by a technique called canceling, which was simply the printing by the Post Office of a particular graphic design, the cancellation mark, on the stamps as evidence that the stamps had been used and could not be used again. This same technique was used in the early development of printing devices for postage meters so that an indicia could not be cut off of one envelope and pasted onto another. In either event, in order for the mail to be properly canceled, it had to be in the same orientation so that it could be fed at high speed through the canceling machines.

As time passed, the Postal Service has substantially discontinued the practice of running mail with postage meter indicia thereon through canceling machines. However, a more significant problem than the security aspect discussed above is that in modern mail handling facilities, where enormous quantities of mail are handled on a daily basis, the mail must be sorted in high speed automatic sorting machines, and this requires that certain information on the front of the envelopes, typically addresses in bar code form and postnet bar codes, be machine readable. Thus, all mail, regardless of whether it bears stamps or printed postage indicia, must be oriented in the same manner, a requirement similar to that for passing the mail through canceling machines.

Thus, regardless of the purpose of orienting the mail in a uniform manner, this is accomplished in so-called automatic facing machines in which a fluorescent material detecting device looks at the postage stamp or postage indicia area of the envelopes passing through the facing machine for the presence of fluorescent material. This material was incorporated into postage stamps and has also been incorporated into the ink used in conventional postage maters, so that if the fluorescent detector in the facing machine does not detect fluorescent material as an envelope passes the detector, the envelope is diverted out of the normal path of the mail and is reoriented and again passed through the facing machine to ensure that it is then properly oriented. This process can be repeated until the facing machine finally detects that the envelope is properly oriented. Without this type of automatic equipment, the drastic reduction in the through put rate in modern mail handling facilities would virtually bring the system to a halt.

As time passed, it became apparent that the ink used in the former die type printing devices, in addition to being fluorescent, also had to be water fast in order to meet rigid Postal Service standards for acceptable postage meter ink. There are many ways in which mail can be subject to excessive moisture, such as water from envelope sealing devices in the mailing machines inadvertently transferring onto the postage indicia, rain reaching the envelopes during outdoor transfer, spilling of liquids in the office, etc. The moisture from any of these or other causes can smear the ink of an indicia after it is printed and render it either unreadable by the human eye or by machine readable techniques. Therefore, inks were developed which had essentially an oil base constituent which was more thoroughly absorbed into the fibers of the paper from which the envelopes were made than water base inks, with the result that they would not smear even from being subjected to excessive moisture, such as the direct application of water.

Thus, the ink generally accepted for use in postage meters for a long period of time had the characteristics both of being highly water fast, i.e., sufficiently permanent so as not to smear even if subjected to excessive moisture, and also fluorescent so as to be machine readable to facilitate proper orientation of the mail in automatic high speed canceling and/or sorting machines.

As briefly noted above, in the course of the development of postage indicia printing devices utilizing ink jet technology, it was soon recognized that the inks developed for use in ink jet printing devices could not be used to print postage indicia because there was no machine readable fluorescent material in those inks. Also, the commercially available inks used in the conventional postage meters could not be used in the most desirable technique for ink jet printing, that of bubble jet printing, because the oil base prevented the ink from boiling and vaporizing in the ink ejecting mechanism to eject ink from the nozzles of the printing device, thereby rendering the commercially available postage meter ink unusable. Thus, it was found that the dye structures of the inks were such that the characteristics of water fastness and fluorescence could not be combined in a single ink that would work in ink jet printers of the bubble jet type, since these printers require water base ink.

It was soon found that the dye structure of the inks being used for printing postage meters was such that the essential characteristics of water fastness and fluorescence simply could not be combined in a single ink that would be suitable for the most desirable technique of ink jet printing, that of bubble jet printing. The constituent of the ink that makes it water fast has an adverse effect on the fluorescence, thereby rendering the indicia unreadable by the known fluorescent detectors, and eliminating that constituent prevented the ink from being water fast.

Thus, the entire development of a commercially acceptable ink jet printing device for use in postage meters was seriously impeded for lack of a readily available and commercially viable ink. So it is apparent that there is a need for an alternative method of obtaining the benefits ink jet technology in the printing of postage meter indicia without losing any of the desirable qualities or characteristics of current methods of indicia printing.

BRIEF SUMMARY OF THE INVENTION

The present invention substantially obviates, if not entirely eliminates, the disadvantages and problems discussed above in connection with adapting the technique of ink jet printing to the printing of postage indicia. Since it was found to be virtually impossible to develop a single ink that would have the necessary characteristics of both water fastness and fluorescence for the standard mature available print heads, the quest for an acceptable solution turned to adapting the format of the postage indicia to accommodate the limitations of the ink jet technology, so that an indicia could be printed which would have these characteristics and still be able to use commercially available printing devices and ink.

It was found that the foregoing objective could be accomplished if the design of the postage indicia was modified so that was composed essentially of two components, an alphanumeric component which had to be printed with water fast ink, which was commercially available in a water based form developed for other purposes but was sufficiently water fast to meet the Postal Service standards for water fastness, and a graphic component which could be printed with a commercially available water based ink that contained a fluorescent material but which was less water fast. Thus, the format of the indicia was so modified with the result that it could be printed with commercially available ink jet printing devices and with readily available ink.

In its broader aspects, therefore, the present invention is a method of printing a postage indicia image on an image receiving medium utilizing ink jet printing technology, the image being composed of discrete portions each of which is to be printed with an ink having a distinct and unique characteristic. The method comprises the steps of providing a pair of ink jet print heads, each of which has a linear array of ink jet nozzles, a reservoir for holding a supply of ink, and actuating means interposed between the array of nozzles and the reservoir for ejecting ink from the nozzles onto the image receiving medium in a predetermined image pattern. Ink is provided having a different unique characteristic in the reservoirs, and then causing relative movement between the image receiving medium and the plurality of print heads. Finally, each of the actuating means is activated simultaneously during a single pass of the relative movement between the image receiving medium and the print heads to cause ink from each of the print heads to be deposited on the image receiving medium during the single pass in a predetermined sequence of operation for each print head, with the result that one portion of the postage indicia image is printed with ink having a certain unique characteristic and simultaneously another portion of the image is printed with ink having a different unique characteristic.

In some of its more limited aspects, the linear arrays of ink jet nozzles of said print heads are arranged in end to end relationship so that one of the arrays prints an upper portion of the image and another array prints a lower portion of the image. The step of causing the relative movement includes the step of maintaining the print heads stationary and causing the image receiving medium to move past the print heads Having briefly described the general nature of the present invention, it is a principal object thereof to provide a method of printing postage indicia on envelopes utilizing ink jet printing technology in which the characteristics of water fastness and fluorescence are retained despite the virtual impossibility of providing a commercially acceptable ink having both of these characteristics.

It is another object of the present invention to provide a method of printing postage indicia on envelopes utilizing ink jet technology in which the postage indicia retains the characteristics of both water fastness and fluorescence in different portions of the indicia, and the printing is accomplished with commercially available printing devices and ink therefor.

These and other advantages and features of the present invention will become more apparent from an understanding of the following detailed description of a presently preferred embodiment of the present invention, when considered in conjunction with the accompanying drawing.

DETAILED DESCRIPTION OF THE INVENTION

Figure 1:
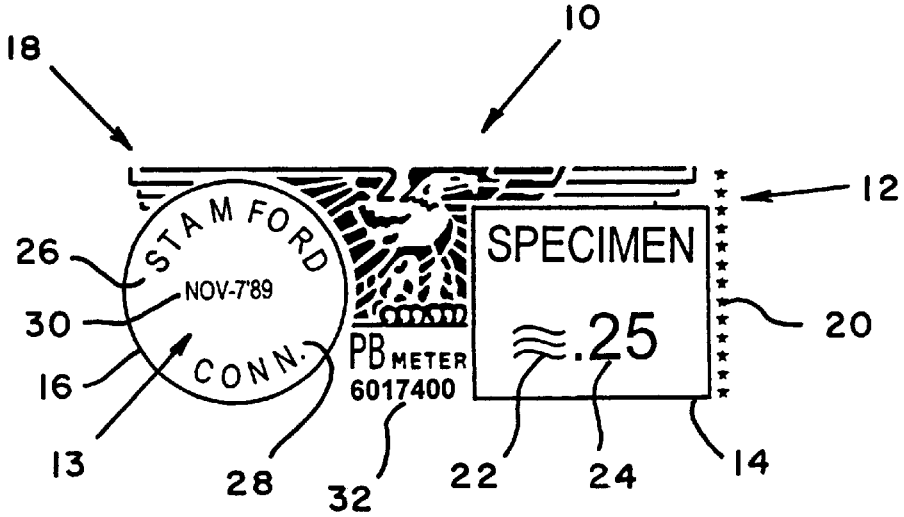
FIG. 1 (PRIOR ART)
FIG. 1 shows a typical postage meter indicia as printed with currently available postage meter printing devices, and is intended to illustrate the problems encountered in attempting to adapt this type of indicia to printing with ink jet technology.

Referring now to the drawings, and particularly to FIG. 1 thereof, there is seen a typical postage meter indicia, designated generally by the reference numeral 10, and which basically comprises two elements, a graphic element indicated generally by the reference numeral 12 and an alpha-numeric element indicated generally by the reference numeral 13. The graphic element 12 consists of a square 14 on the right side of the indicia 10, circle 16 disposed in spaced relationship with the square 14 on the left side of the indicia 10, and a representation of an eagle indicated generally by the reference numeral 18 with the head thereof generally centered between the square 14 and the circle 16 and the wings thereof overlying the square and the circle. A row of stars 20 is disposed in vertical relationship adjacent the right side of the square 14. A plurality of wavy lines 22 are disposed within the square to represent the cancellation mark formerly overprinted on postage stamps and printed postage indicia as described above.

The alpha numeric element 12 comprises an amount of postage 24 disposed generally centrally in the square 14, the city of origin 26 of the particular postage meter disposed in the upper part of the circle 16, the state of origin 28 disposed diametrically opposite to the city 26, and the date 30 on which the indicia is printed disposed centrally in the circle 16. Finally, the abbreviation of the manufacturer of the postage meter and the serial number thereof, indicated generally by the reference number 32, are disposed in the space between the lower portions of the square 14 and the circle 16.

It will be apparent from the foregoing that the only manner in which this design can be printed in a single pass through a printing device is to print the entire indicia 10 at the same time. In view of the high volume of mail that must be processed, and therefore the speed with which mail moves through mailing machines, it would be entirely unacceptable to attempt to print the indicia in more than one pass, since this would require stopping the envelope in the mailing machine, reversing its movement for a predetermined distance, and passing it through the printing device a second time. Not only would this technique reduce the throughput rate of the mailing machine to a commercially unacceptable level, but also it would create serious registration problems in ensuring that any information printed during the second pass was precisely registered with the information during the first pass. The mechanism for accomplishing this would substantially increase the complexity and cost of the mailing machine.

As discussed above, there is no problem in printing the postage indicia in a single pass of the envelope through conventional postage indicia printing devices because it is printed with an inked dye, and the ink has the characteristics of both water fastness and fluorescence. The problems that arise in attempting to print this postage indicia utilizing standard mature ink jet technology are, one, that it must be printed in a single pass as just explained, and it is impossible to do this with two ink jet printers utilizing different inks because the alpha-numeric information is interspersed with the graphic information, and two, that there is presently no satisfactory ink available for ink jet printers that has both characteristics, and present research indications are that it may be physically impossible to develop such an ink due to the inherent incompatibilities in the dye structures of the water fast and fluorescent components of the ink.

Thus, the quest for a commercially acceptable solution to this problem shifted from the development of a single ink having the characteristics of both water fastness and fluorescence to redesigning the indicia to accommodate the limitations of the ink jet printing technology concerning the ink. Thus, with reference to FIG. 2, it will be seen that the redesigned indicia 10 is divided into two distinct areas, with the graphic element 12' occupying approximately the upper half of the area of the indicia 10' and the alpha-numeric element 14' occupying the approximate lower half of the indicia 10' It is apparent that the indicia 10', being of less height than the earlier indicia 10, is more suitable to being printed with an ink jet printer due to the physical limitation in the length of the nozzle array which determines the height of any image printed by this technique.

A better understanding of the method of the present invention will be facilitated by understanding the general nature of a typical ink jet printer. It includes a print head which has a nozzle plate on which there is a linear array of minute apertures or nozzles, the nozzle plate being disposed in closely spaced relationship to the surface of an image receiving medium during a printing operation in which there is relative movement between the image receiving medium and the print head. The print head includes a reservoir for storing ink, and there is an actuating mechanism interconnecting the reservoir and the nozzles for periodically ejecting a minute droplet of ink from the nozzles. In a bubble jet ink jet printer, which is well known in ink jet printing technology, the actuating mechanism for ejecting the ink comprises a heating chamber and a heating element disposed therein, there being an individual chamber for each nozzle and a channel communicating between the heating chamber and the nozzle. With the aid of suitable software and a microprocessor, the heating elements in the various chambers are actuated momentarily to cause the ink therein to boil and vaporize, thereby creating a small bubble in the heating chamber, and the pressure created by the expansion of the bubble within the heating chamber is sufficient to force a minute droplet of ink from the nozzle. The software and the microprocessor control the sequence of operation and the timing thereof to control the ejection of ink from the nozzles in order to form the desired image pattern. Ink jet printers of this type are well known and commercially available, and further description and illustration thereof is readily available in patent and other literature, and further description and illustration herein is not deemed necessary for a full and complete understanding of the present invention.

In actual practice, the length of a typical array of nozzles on the nozzle plate is about three eighths of an inch. Since, the indicia 10' is approximately three quarters of an inch high, at least two linear arrays of nozzles must be provided which are arranged in end to end relationship in order to have sufficient nozzles to print the full height of the indicia 10'. It may be necessary, in order to physically accommodate two arrays of nozzles in the same printing device, to offset them somewhat in the longitudinal direction of the indicia 10', but they would still be disposed laterally with the end of one array immediately adjacent the corresponding array of the other, in order to print the indicia 10' shown in FIG. 2. However, it would be possible to intermix a portion of both images somewhat by not only offsetting the two arrays longitudinally but also overlapping them so that a portion of one array will print in the same area of one image as an adjacent portion of the other image, but at different times. By appropriately controlling the operation of the printing devices to achieve the printing at different times, a portion of alpha-numeric data can be intermixed with a portion of the graphic data as a variation of the straight line separation of the two discrete images shown in the drawing. FIGS. 3*a* and 3*b* illustrate nozzles 44 with exemplary nozzle arrays.

Figure 2:
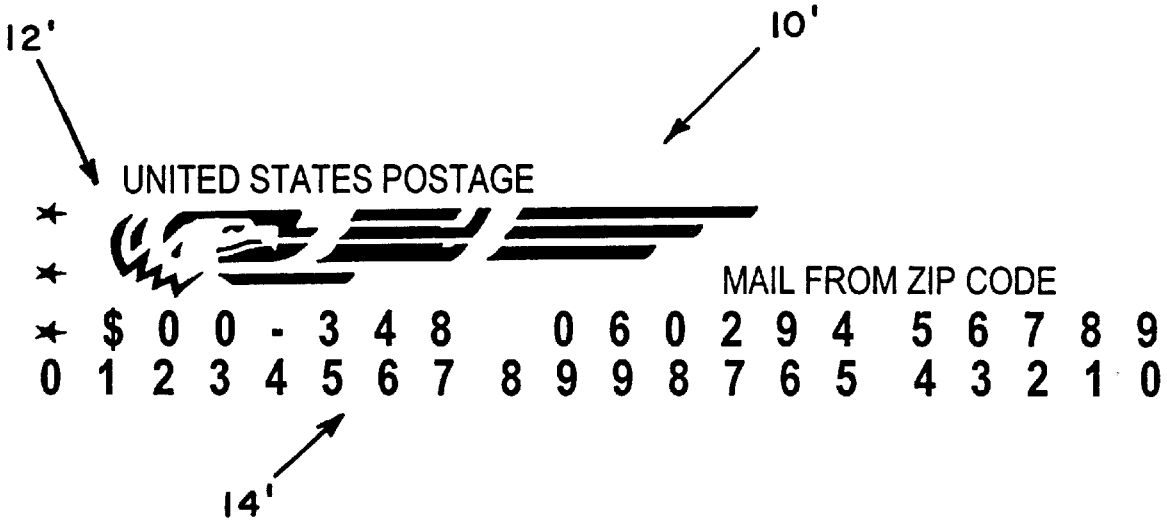
FIG. 2 shows a representative postage indicia as redesigned for printing in accordance with the method of the present invention.
Figure 3A:
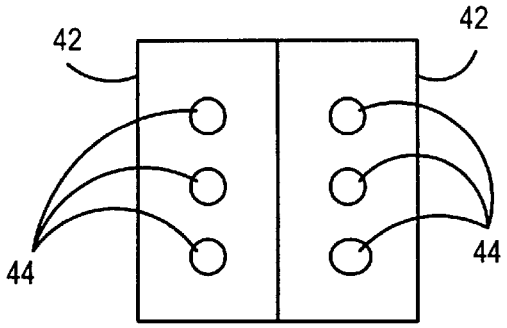
FIGS. 3*a* and 3*b* show a pair of ink jet print heads with nozzle arrays.
Figure 3B:
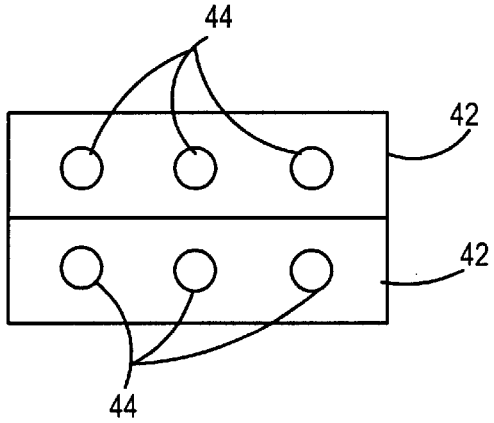
Figure 4:
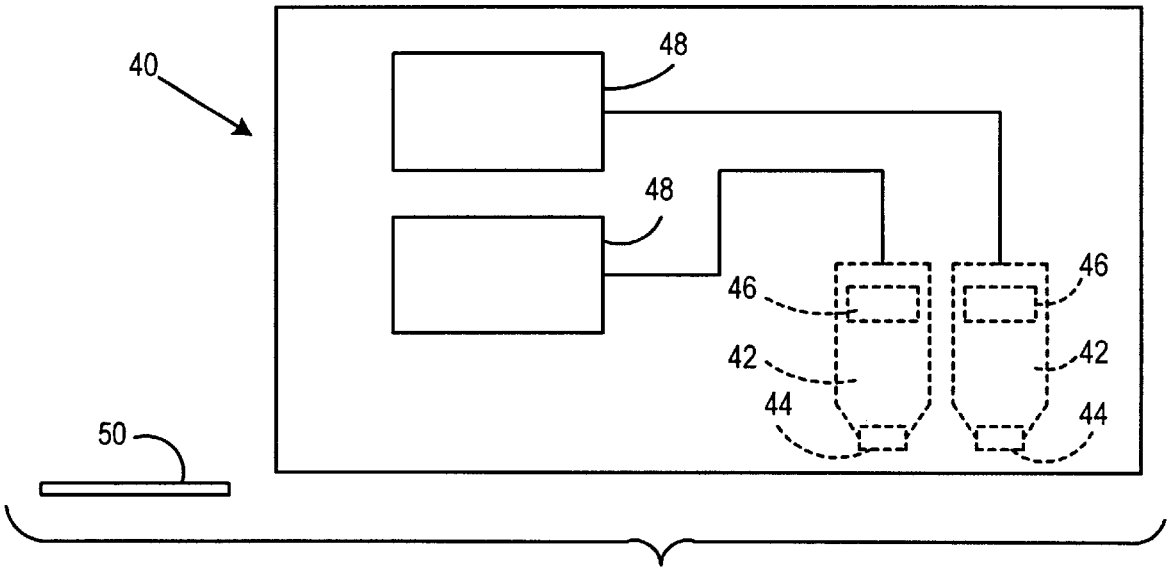
FIG. 4 shows a postage printing device for printing postage indicia using two ink jet print heads.

Thus, the present invention is the method of printing the postage indicia 10' as shown in FIG. 2 utilizing ink jet printing devices of the type just described with the readily available inks that have the required characteristics either of water fastness or fluorescence. The ink jet printing device 40 is illustrated in FIG. 4 and prints postage indicia on image receiving medium 50. The first step is to provide a pair of ink jet print heads 42, each of which has a linear array of ink jet nozzles 44, a reservoir 46 for holding a supply of ink, and actuating means 48 interposed between the array of nozzles and the reservoir for ejecting ink from the nozzles in a predetermined image pattern. From a packaging standpoint, the individual print heads, reservoirs and actuating means could be disposed in separate cartridges inserted in the printing device, although in the interest of economy of space, it would be preferable to place them all in the same cartridge, in much the same manner as the multi-color ink cartridges used in some computer printers.

The next step is that ink is provided in each of the reservoirs that has a different unique characteristic, i.e., one is formulated to be water fast and the other is formulated to be fluorescent. Any suitable mechanism is provided for causing relative movement between the image receiving medium, typically an envelope, and the printing device, although in general practice, the envelopes are moved through the mailing machine and the printing element remains stationary relative to the envelope. It is also standard practice to print postage indicia on labels which are then applied to envelopes which are thick or irregular in shape and therefore cannot be fed through a mailing machine.

The next step is to activate the actuating means of each of the print heads simultaneously during a single pass of an envelope through the mailing machine so that ink from each of the print heads is deposited on the envelope during the movement thereof in a predetermined sequence of operation for each print head. This is accomplished in known manner by utilizing a microprocessor and appropriate software in a manner that energizes the heater in each of the heating chambers, as described above, in a predetermined sequence, to create the bubbles therein that eject the minute droplets of ink from the nozzles associated with the individual heating chambers. This causes the ink to be deposited on the envelope in the desired image pattern.

It will be understood that the printing from both print heads is taking place simultaneously as the envelope passes under the print heads, i.e., the print head that is supplied with the fluorescent ink is printing the graphic portion 12' of the indicia 10', and simultaneously the print head with the water fast ink is printing the alpha-numeric portion 14' of the indicia 10'. Even if one of the print heads is slightly offset from the other, either for the purpose of convenience of packaging or to facilitate intermixing of the images, the printing from both print heads is still substantially simultaneous even though the respective printing operations may not commence and terminate in exact synchronism.

Thus, it will now be apparent that since there is no critical data in the graphic portion 12' of the indicia 10' which must be machine readable, this portion can be printed with the print head supplied with fluorescent ink, even though this ink is not very water fast. The alpha-numeric portion 12', on the other hand, does contain data which must be machine readable and therefore is printed by the other print head which is supplied with the water fast ink, with both images being printed simultaneously.

Many features of the preferred embodiment represent design choices selected to best exploit the inventive concept as implemented in the inventor's particular application. For example, the array of nozzles need not be linear in order to practice the invention. The nozzle array may take on any suitable geometric configuration. As another example, the use of two print heads is specifically referred to above. However, a single print head including a first set of nozzles coupled to a first ink reservoir and a second set of nozzles coupled to a second ink reservoir where the first ink and the second ink have different characteristics could easily be substituted by those skilled in the art. Additionally, those skilled in the art will recognize that this invention may find application in applications. Moreover, additional advantages than those described above and various modifications will readily occur to those skilled in the art. Therefore, the inventive concept in its broader aspects is not limited to the specific details of the preferred embodiment but is defined by the appended claims and their equivalents.

What is claimed is:

1. A method of printing a postage indicia image on a medium utilizing ink jet printing technology, said postage indicia image being composed of first and second portions, said method comprising the steps of:

a. providing first and second ink jet print heads, said first ink jet print head comprising a first array of ink jet nozzles, a first reservoir for holding a first ink, and first actuating means interposed between said first array of nozzles and said first reservoir for ejecting said first ink from said first array of nozzles onto said medium;

said second ink jet print head comprising a second array of ink jet nozzles, a second reservoir for holding a second ink, and second actuating means interposed between said second array of nozzles and said second reservoir for ejecting said second ink from said nozzles onto said medium;

b. providing said first ink in said first reservoir, said first ink being water fast;

c. providing said second ink in said second reservoir said second ink being water based fluorescent;

d. causing relative movement between said medium and said first and second ink jet print heads; and e. activating said first and second actuating means during a single pass of said relative movement between said medium and said first and second ink jet print heads to respectively cause said first and second inks from said first and second ink jet print heads to be deposited on said medium during said single pass, whereby said first ink jet print head prints an alpha-numeric portion of said image with said water fast first ink, and said second ink jet print head prints a graphic portion of said image with said fluorescent second ink.

2. A method as set forth in claim 1 wherein said first and second arrays of ink jet nozzles of said first and second ink jet print heads are arranged in end to end relationship so that one of said arrays of ink jet nozzles prints an upper portion of said image and the other of said arrays of ink jet nozzles prints a lower portion of said image.

3. A method as set forth in claim 1 wherein said first and second arrays of ink jet nozzles of said first and second ink jet print heads are arranged in overlapping relationship whereby the respective images printed by each ink jet print head are intermixed.

4. A method as set forth in claim 1 wherein said step of causing said relative movement includes the step of maintaining said first and second ink jet print heads stationary and causing said medium to move past said first and second ink jet print heads.

5. A method as set forth in claim 1 wherein an alpha numeric portion of said indicia is printed with said first ink and another portion of said indicia is printed with said second ink.

6. The method as claimed in claim 1, further comprising the step of:

f. controlling said first and second actuating means and coordinating sequence of operation of said first and second ink jet print heads and timing of said first and second ink ejection from said first and second arrays of nozzles.

7. The method as claimed in claim 1, wherein in step (e), said actuating means are activated concurrently.

8. The method as claimed in claim 1, wherein in step (e), said actuating means are activated at different times.

* * * * *